United States Patent [19]

Hasegawa

[11] Patent Number: 4,840,341

[45] Date of Patent: Jun. 20, 1989

[54] CLIP AND HOLDER

[76] Inventor: Gary K. Hasegawa, 1457 W. Hutchinson Ave., Chicago, Ill. 60613

[21] Appl. No.: 191,345

[22] Filed: May 9, 1988

[51] Int. Cl.[4] ..... A47F 5/00

[52] U.S. Cl. ..... 248/316.5; 211/89

[58] Field of Search ..... 248/316.5, 231.8, 231.5, 248/316.7; 211/89, 45; 24/458, 460, 493, 505, 506, 522, 519

[56] References Cited

U.S. PATENT DOCUMENTS

| | | | |
|---|---|---|---|
| 2,695,105 | 11/1954 | Mitchell | 211/89 X |
| 3,122,802 | 3/1964 | Kaufman | 24/506 X |
| 3,597,813 | 8/1971 | Takahashi | 24/508 X |
| 3,964,708 | 6/1976 | Reeves | 211/89 X |
| 4,290,575 | 9/1981 | Swartwout | 211/89 X |
| 4,291,810 | 9/1981 | Rubenstein | 248/316.5 X |
| 4,693,443 | 9/1987 | Drain | 211/89 X |
| 4,733,988 | 3/1988 | Kelly | 24/516 X |

FOREIGN PATENT DOCUMENTS

| | | | |
|---|---|---|---|
| 2704023 | 8/1978 | Fed. Rep. of Germany | 24/508 |

*Primary Examiner*—J. Franklin Foss

*Attorney, Agent, or Firm*—John J. Kowalik

[57] ABSTRACT

A clip assembly having a pair of cooperative pivotally interconnected clip members with integral spring means biasing the clip members to article-grasping position and a releaseable latch on one member operative to engage a catch on the other member for holding the members in open position to facilitate entry of articles between the article-grasping jaws of the clip members, the clip assembly being slidably mounted on a support for movement to laterally adjusted positions. The spring means is also operative to deflect one of the clip members to hold it tightly in interlocking engagement with the support.

16 Claims, 1 Drawing Sheet

CLIP AND HOLDER

BACKGROUND OF THE INVENTION

This invention relates to devices commonly known as clips for holding articles together. Such clips are usually attached to the upper end of a board and are generally known as clip boards. The clip is made of metal and has torsion spring loaded clip portions which are pivotally interconnected. Sometimes the board serves as one of the clip members.

SUMMARY OF THE INVENTION

The invention is directed to a novel plastic clip assembly which may be fabricated by extrusion and in which an elongated plastic strip is provided having an adhesive or magnets bonded to its back side for adhesion to a wall or the like and having a ribbing on its front side for slidably interlocking with the back portion of the clip for adjustable positioning thereof. The back portion of the clip is pivotally interlocked with the front portion of the clip which is pivotal between an open or article receiving position and a closed or article grasping position. The front portion in one embodiment of the invention has an integral plastic leaf spring molded thereon bending in a guide formed in the back portion of the clip in a guide formed thereon. In both embodiments the front and back portions of the clip have interlocking latching members molded thereon for releasably holding the lip in open position. In the second embodiment the clip portions are connected by an interlocking grasp assembly which function as leaf springs for holding the clips in closed position.

A principal object is to provide a clip assembly which is easily manufactured and assembled.

These and other objects and advantages inherent and encompassed by the invention will become more apparent from the specification and the drawings, wherein.

Figure 6:
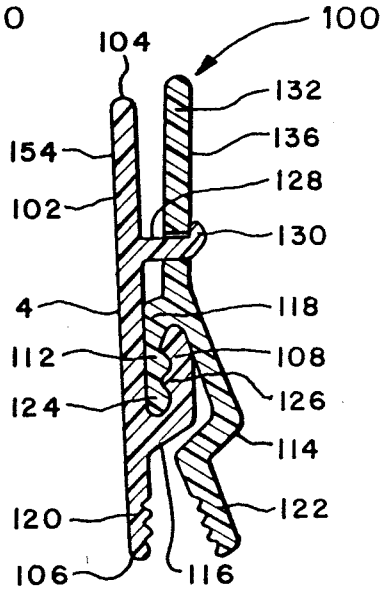
FIGS. 5 and 6 illustrate a modification.
Figure 5:
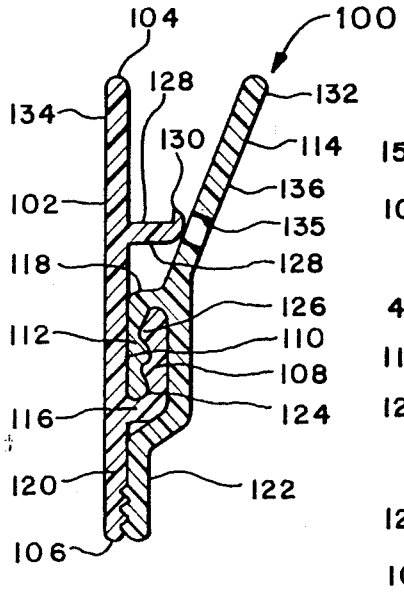

FIG. 5 being a cross-section of a clip assembly shown in closed position, and FIG. 6 showing the assembly in open position.

DESCRIPTION OF FIGS. 1–4A

FIGS. 1 through 4A depict a clip assembly generally designated 2 comprising an elongated plastic mounting strip 3 of flexible material such as polyethylene or polypropylene or the like which has a preferably flat back side 4 to which is secured a front face 5 of a thin band of adhesive material 6.

The band 6 has a tacky back side 7 on which is releasably secured a suitable peelable backing material or strip 8 which may be removed to expose the side 7 which may be adhered to a suitable wall surface or the like (not shown).

The mounting piece or strip 3 comprises a bar or rib 20 formed on its front side with reversely upwardly and downwardly directed teeth 12, and 14 located between the top and bottom edges 16, 18 of the strip. The bar 10 is entered into a groove 20 in the back side of the of the inner or back clip member 24' as at 22. Member 24' has at the top and bottom of the groove upper and lower downwardly and upwardly directed teeth 25 and 26 which enter grooves 27,28 in the mounting strip and lock behind the teeth 12,14, respectively. The clip is slidable lengthwise of the strip 3.

An outward projection 15 is formed on the front side of the inner clip member 24' intermediate its upper and lower ends and has top and bottom prongs 30,32 defining a cylindrical pivot socket 34 receiving a complementary cylindrical pivot member 35 formed on the back side of the front clip member 36. The prongs 30,32 are resilient and are biased toward each other and at their distal end 38,40 are spaced apart a distance less than the diameter of the pivot member 35 and releasably embrace the same. All of the parts of this assembly and the second embodiment are made of resilient plastic material.

An integral leaf spring 45 located above the pivot 35 extends from the back side of the front clip member 36 and is curled downwardly at its distal end and is C-shaped in elevation and is formed of the same material as the clip. At one end it is integrally molded with the front clip 36. It has an arcuate outer face 46 slidable within a shallow groove 48 complemental with face 36, the groove being formed in the front side of the rear clip member. The spring is stressed in bend.

The spring is located between the pivot and upper section of the front clip which is formed along its upper edge with a rigidifying bead 50.

Figure 2:
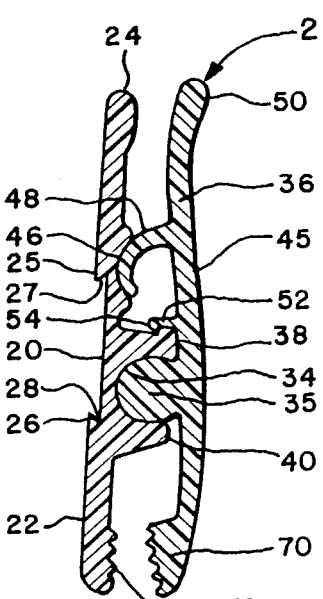
FIG. 2 is a cross-section of the clip assembly in open position.
Figure 1:
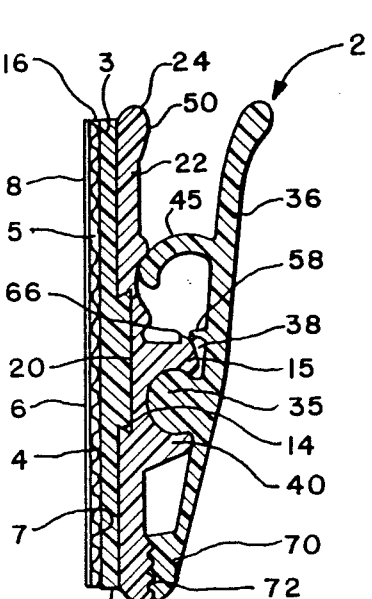
FIG. 1 is a cross-section of the clip assembly in closed position
Figure 4A:
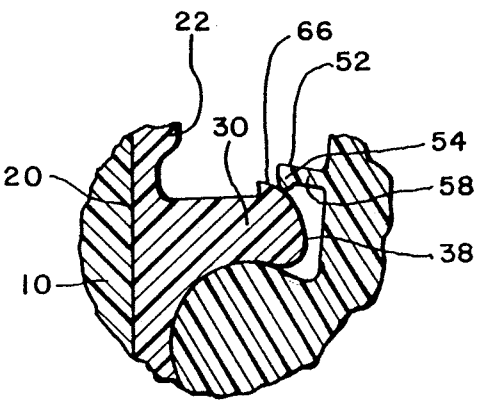
FIG. 4A is an enlarged cross-section of the latching portion.
Figure 4:
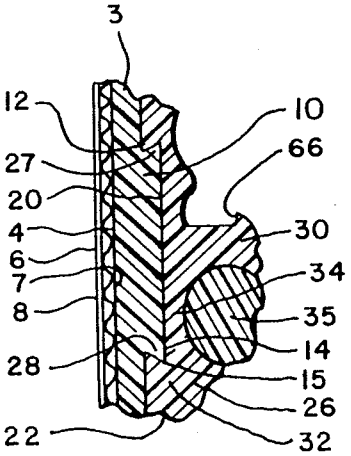
FIG. 4 is an enlarged cross-section of the pivot portion of the clip assembly shown in FIG. 1.
Figure 3:
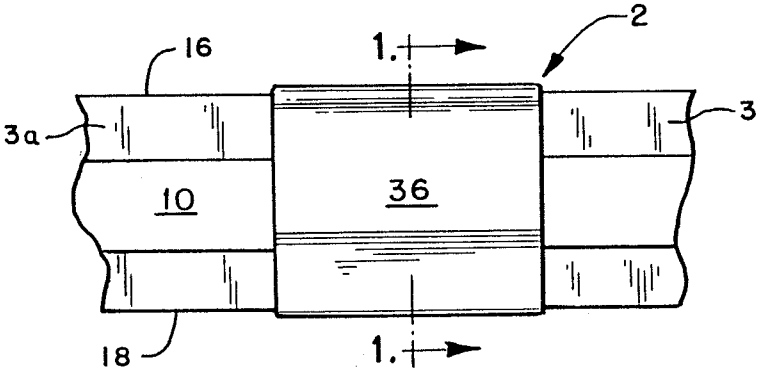
FIG. 3 is a fragmentary front view of the assembly.

The clip has a locked-open position as seen in FIG. 2. This is provided by a latching device 52 which comprises a latching hook 54 on a flexible arm or cantilevered spring 58 which is connected at one end to the back side of the front clip above the pivot.

The spring arm 58 is flexible vertically and has a latching hook at its distal end which in operation as shown in FIG. 2 catches behind an upstanding lower hook 66 formed on the top side of the upper prong. The engaging faces on the hooks 54,66 and the flexibility of the arm 58 are so arranged that upon applying sufficient pressure on the lower extremity 70 of the front lip member 36, the hooks will separate by the upper hook 54 sliding over the lower hook 66 and under urging bu the spring 58 the front clip will close to hold an item against the opposing serrations 72 on the lower end portion of the back clip member. The clip assembly will open attendant to the user pressing the upper portion of the front clip member toward the rear member.

It will be apparent that the front and rear clip members and the mounting strip are so designed that they can be extrusion molded.

DESCRIPTION OF FIGS. 5 AND 6

The flexible plastic clip assembly generally designated 100 is functionally somewhat similar to the previously described assembly, and like parts will be identified by the same reference numerals.

The lip assembly 100 is shown closed in FIG. 5 and open in FIG. 6. In this embodiment the rear member is shown essentially flat and intermediate its top and bottom ends 104,106 is formed with a grasp 108 defining an upwardly open slot 110 with the opposing portion of the rear member 102 and is interlocked with a downwardly extending grasp 112 which is formed on the back side of the front clip member 114, and is offset therefrom to form a downwardly open slot 119 receiving the grasp 112 therein. The attaching end portions 116,118 of the grasps to the front and rear clip member respectively are deflectible and in effect form a pivot assembly accommodating the front clip member 114 to pivot with respect to the rear member to open and close the jaw portions 120,122 at the lower ends of the front and rear clip members. The grasps have interfitting teeth 124,126 which resist separation of the grips.

The rear or base member 102 has an outwardly projecting latch arm on its front side, the arm 128 having a hook end 130 which in the open position of the clip assembly is disengaged. Upon opening the clip the upper end portion of the front clip member is pressed toward the upper portion 134 of the rear clip member whereupon the hooked end 130 passes through an aperture 135 in the front clamp member and hooks behind the front face 136 of the front clip member or more specifically in front of the front face 136 as seen in FIG. 6. The hook 130 is released by the user pressing on portion 122 or pulling the portion 132 away from the rear clip member opposing portion, with sufficient force to cause the latch member 128 to deflect downwardly thus causing the hook end to slide downwardly and permit it to pass through the aperture 135 and the lower jaw portions to relatively advance toward each other in closed position as seen in FIG. 5.

Thus two simple and effective clips have been disclosed. Other modifications will now become apparent which are intended to come within the scope of the appended claims.

A feature of the construction of FIGS. 1-4A is in arranging the spring 45 so that it deflects an opposing flexible portion of the rear clip member 24' so as to tightly hold the same in engaged relation with the bar 10.

I claim:

1. A flexible plastic clip assembly comprising:

an elongated support bar, first and second pivotally interconnected clip members pivotal between closed and open positions for respectively grasping articles and releasing the same, means interlocking said first slip member to said bar for adjustable movement along the bar lengthwise thereof, and spring means interposed between said members for biasing said second member to closed position with said first member, said first member having a flexible portion in the region of said interlocking means and said spring means engaging and operative to deflect said portion of said first member into tight interlocking relation with said bar to hold the clip assembly from moving along the bar.

2. The invention according to claim 1 and said spring means comprising a cantilevered spring element integrally connected with one of said members and reactively engaging the other member.

3. The invention according to claim 2 and said other member having an arcuate guiding slide surface in the area of engagement of said spring element therewith for imposing a bend couple on the spring means.

4. The invention according to claim 1 and a releasable latch interposed between said clip members for holding said clip members in open position.

5. The invention according to claim 1 and said first member having a pair of opposed prongs defining a pivot aperture therebetween and said second member having a pivot rod integral therewith and entered into said pivot aperture and forming said pivotal interconnection between said members.

6. The invention according to claim 1 and said spring means comprising a plastic leaf spring stressed in bend between said first and second clip members.

7. The invention according to claim 4 and said latch means comprising a bendable resilient arm mounted at one end to one of said clip members and having a distal end with a catch thereon, and means for catching said catch on the arm and releasable therefrom upon application of a tensile load on the arm by pulling on a portion of said other clip member .

8. The invention according to claim 1 and said interlocking means comprising interdigitating teeth on said first member and said support bar.

9. A flexible plastic clip assembly comprising a pair of pivotally interconnected clip members, a jaw portion formed at one end of each member, said members being pivotal to a position opening said jaw portions for reception or release of articles entered therebetween and for closing said jaw portions to an article holding position, means for mounting said assembly from an associated support including means having parts for interlocking one of said members with the mounting means, biasing means interposed between said members for urging the same to closing position of their jaw portion, said biasing means further being operative deflect and thus hold said parts of said interlocking means in tight interlock relation with each other.

10. The invention according to claim 9 and said biasing means comprising spring means reactively positioned between opposing portions of respective members.

11. The invention according to 9 and said pivotal interconnection comprising elements integral with the respective clip members having a snap-fit connection with each other.

12. The invention according to claim 10 and cooperative releasable latch means on said members operative to latch said members in open position attendants to said members being manually disposed in open position.

13. The invention according to claim 12 and said latch means comprising a flexible hook-ended arm connected to one member and means on the other member operative to hook with said hook-end.

14. The invention according to claim 13 and said arm being integrally formed with said one member.

15. The invention according to claim 10 and said spring means comprising a flexible plastic element extending from one member to the other and, said other member having means engaging the distal end portion of said element and operative to stress it in bend attendant to said members being pivoted to open position.

16. The invention according to claim 15 and said means engaging said distal end portion comprising an arcuate seat and, said distal end portion having a curved comformation and, said seat having a comformation complemental to the curvature of said distal end portion.

* * * * *